US005584476A

United States Patent [19]

Marzullo et al.

[11] Patent Number: 5,584,476

[45] Date of Patent: Dec. 17, 1996

[54] APPARATUS AND METHOD FOR FEEDING PRINT MEDIA FROM A STACK

[76] Inventors: Joseph H. Marzullo, 7 Old White Turkey Rd., Brookfield, Conn. 06804; Brian S. Thompson, 230 New Haven Ave., Derby, Conn. 06418

[21] Appl. No.: 345,880

[22] Filed: Nov. 28, 1994

[51] Int. Cl.[6] ..... B65H 1/14

[52] U.S. Cl. ..... 271/126; 271/153; 271/156

[58] Field of Search ..... 271/34, 126, 127, 271/152, 153, 154, 155, 156

[56] References Cited

U.S. PATENT DOCUMENTS

| | | | |
|---|---|---|---|
| 1,285,432 | 11/1918 | Shults | 271/156 |
| 2,989,307 | 6/1961 | Weidenhammer | 271/153 |
| 3,764,129 | 10/1973 | Yanagawa | 271/156 |
| 4,232,859 | 11/1980 | Tokuno . | |
| 4,235,432 | 11/1980 | Marshke | 271/153 X |
| 4,268,027 | 5/1981 | Oleksiak et al. . | |
| 4,302,000 | 11/1981 | Frank | 271/153 X |
| 4,524,963 | 6/1985 | D'Angelo et al. . | |
| 4,529,188 | 7/1985 | Sturnick . | |
| 4,566,684 | 1/1986 | Gysling | 271/153 X |
| 4,935,780 | 6/1990 | Yamada et al. . | |
| 5,072,921 | 12/1991 | Golicz . | |
| 5,195,737 | 3/1993 | Ifkovits, Jr. et al. . | |
| 5,199,696 | 4/1993 | Kato . | |
| 5,249,787 | 10/1993 | Ifkovits . | |
| 5,476,254 | 12/1995 | Golicz | 271/153 X |

FOREIGN PATENT DOCUMENTS

| | | | |
|---|---|---|---|
| 1313223 | 12/1989 | Japan | 271/153 |
| 6-64760 | 3/1994 | Japan | 271/153 |

OTHER PUBLICATIONS

Fallon et al., "Sheet Feeding Apparatus" IBM Technical Disclosure Bulletin, vol. 19 No. 7, Dec./1976, pp. 2440–2441.

*Primary Examiner*—Karen B. Merritt
*Assistant Examiner*—Scott L. Lowe
*Attorney, Agent, or Firm*—Ronald Reichman; Robert H. Whisker; Melvin J. Scolnick

[57] ABSTRACT

The sheet feeder includes a tray having a pusher mechanism mounted at a rear portion and a feeder mechanism mounted at a forward portion. The pusher mechanism is driven through a spring wrap clutch which includes a ratchet which engages a pawl mounted on the feeder mechanism. When the feeder mechanism is in a first position the pawl is disengaged from the ratchet and the clutch is free to rotate and engage the pusher mechanism which advances the stack of sheets against the feeder mechanism, driving the feeder mechanism back to a second position where the pawl engages the ratchet, disengaging the spring wrap clutch and halting the pusher mechanism. As sheets are fed from the stack a spring urges the feeder mechanism back towards the first position, disengaging the ratchet and engaging the clutch and repeating the cycle. A spring maintains a substantially constant normal force between the feeder mechanism and the stack as the feeder mechanism moves between the first and second positions.

5 Claims, 1 Drawing Sheet

APPARATUS AND METHOD FOR FEEDING PRINT MEDIA FROM A STACK

BACKGROUND OF THE INVENTION

The subject invention relates to an apparatus and method for feeding print media from a stack. (By print media herein is meant items including, but not limited to, sheets, folded inserts, envelopes, postcards and similar items which are comprised in mail pieces.) More particularly, it relates to a method and apparatus suitable for a high capacity feeder capable of handling stacks of up to several hundred print media.

Feeders are well known devices which serve to separate single items from a stack of print media and feed them forward for further processing by apparatus such as copiers, printers and mail processing equipment.

(Those skilled in the art will recognize that feeders generally will be used with a singulation mechanism to assure that only a single sheet at time is fed forward for processing. While necessary for high reliability operation such singulation mechanisms are substantially independent of the sheet feeder and form no part of the subject invention.)

While feeders of various types have generally performed satisfactorily to feed sheets of various types of paper stock, envelopes, and other similar items, a problem has existed in the prior art with regard to the provision of a high capacity multi-media feeder for feeding various items which vary in thickness, weight and other characteristics. As items are fed from a stack it is clearly necessary to provide some mechanism to maintain contact between the feeder mechanism and the stack as items are fed forward and the stack diminishes. This can be most simply accomplished by providing some form of spring driven mechanism which will continuously urge the stack towards the feeder mechanism. While such spring driven mechanisms are inexpensive and simply constructed they do not provide a constant force between the stack and the sheet feeder mechanism over the long range of travel and various types of media inherent in a high capacity multi-media feeder. The varying force between the feeder mechanism and the stack greatly complicates the design of the feeder mechanism; to the extent that, in general, such relatively simple mechanisms for advancing a stack of sheets have not been satisfactory for high capacity feeders, particularly for high capacity feeders intended for feeding various types of print media thick sheets such as envelopes folded sheets, post cards and the like.

Another approach used in feeders in the prior art has been the use of some sort of demand drive mechanism to advance the stack to the feeder mechanism. As sheets were fed from the stack some form of sensor would detect the need for the stack to advance and would generate a signal to the system controller which in turn would activate a motor to energize a mechanism for advancing the stack forwards to the sheet feeder mechanism until the sensor no longer detected the need to advance the stack. Such feeders, however, are generally expensive and require sophisticated sensors, motors and controls to operate.

Accordingly it is an object of the subject invention to provide an improved high capacity sheet feeder.

BRIEF SUMMARY OF THE INVENTION

The above object is achieved and the disadvantages of the prior art are overcome in accordance with the subject invention by means of a sheet feeder which includes a feeder mechanism for feeding sheets from a stack and a stack advance mechanism for moving the stack towards the feeder mechanism when the stack advance mechanism is activated. The sheet feeder also includes a mechanism for activating the stack advance mechanism when the feeder mechanism feeds successive sheets from the stack and advances to a first position and for deactivating the stack advance mechanism when the stack advance mechanism moves the stack against the feeder mechanism and returns the feeder mechanism to a second position.

In accordance with one aspect of the subject invention the sheet feeder includes a mechanism for maintaining a substantially constant normal force between the feeder mechanism and the stack.

In accordance with another aspect of the subject invention, the mechanism for activating the stack advance mechanism includes a wrap spring clutch for coupling a motive force to the stack advance mechanism, a ratchet fixed to the clutch, and a pawl fixed to the feeder mechanism. The pawl is disengaged from the ratchet when the feeder mechanism is in the first position and the clutch is thus engaged and the stack advance mechanism is activated. When the feeder mechanism is in the second position the pawl is engaged with the ratchet and the clutch is disengaged and the stack advance mechanism is deactivated.

DETAILED DESCRIPTION OF PREFERRED EMBODIMENTS OF THE SUBJECT INVENTION

Figure 1:
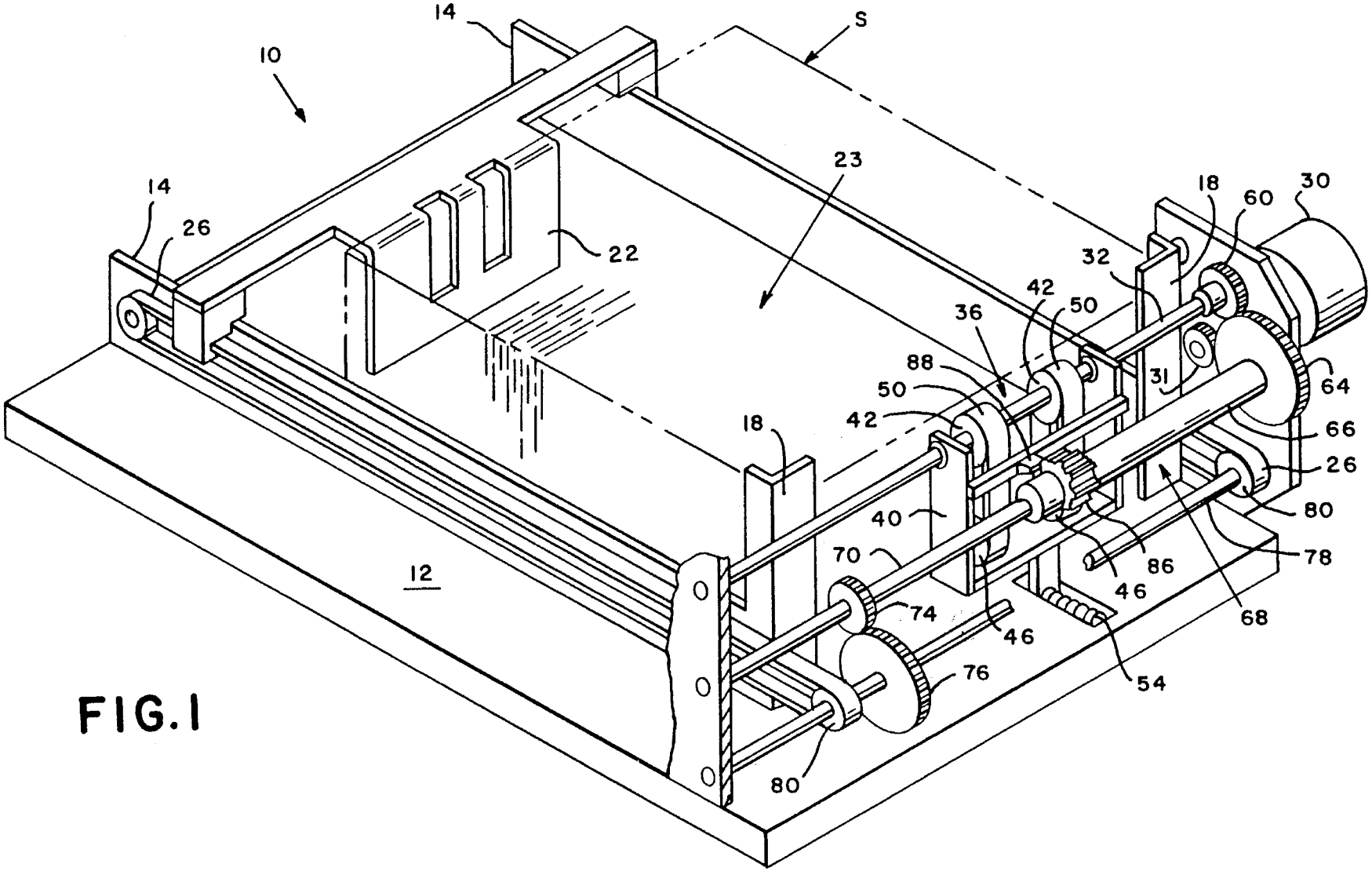
FIG. 1 is a semi-schematic perspective view, partially broken away, of a sheet feeder in accordance with the subject invention.

FIG. 1 shows a semi-schematic, perspective view of sheet feeder 10. (Conventional aspects of the design of sheet feeder 10, such as mountings, gear ratios and other matters of design choice well within the ability of those skilled in the mechanical arts, and which do not form part of the invention per se, are not shown for the sake of clarity and ease of illustration.)

Sheet feeder 10 includes a base 12 on which are mounted a pair of spaced parallel sides 14. Sides 14 each include vertical flanges 18. Pusher 22 is mounted on and guided by sides 14.

Together base 12, sides 14, flanges 18, and pusher 22 define tray 23 for holding a stack of sheets S, shown in phantom, in an orientation perpendicular to base 12.

Pusher 22 is attached to belts 26, and is periodically activated to advance the stack as sheets are fed forward for processing by other conventional apparatus (not shown), as will be described further below.

Motor 30 is mounted in any convenient manner adjacent to the forward end of tray 23. Gear 31 is fixed to the shaft of motor 30 and drives gear 64 which, in turn drives gear 60 to rotate shaft 32, which is mounted in any convenient manner proximate and parallel to the front end of tray 23. Feeder mechanism 36 is mounted at the approximate mid point of shaft 32 to bear upon the front items in stack S through the opening between vertical flanges 18.

Sheet feeder mechanism 36 includes housing 40 through which shaft 32 passes and which is free to rotate about shaft 32. A pair of pulleys 42 (which may be formed as a single double-crowned pulley) are fixed to shaft 32 within housing 40. A second pair of pulleys 46 are mounted at the distal end of housing 40 and a pair of endless friction belts 50 connect pulleys 42 and 46, as will be described further below. Belts 50 bear upon the front sheet in the stack through the opening in housing 40. While belts 50 are preferred, other feeder mechanism such as friction wheels or rollers are within the contemplation of the subject invention.

Spring 54 is mounted between base 12 and housing 40 to provide a normal force between belts 50 and the front sheet in stacks. In a preferred embodiment the sheets in tray 23 will be envelopes and the normal force will be approximately 1.9 newtons.

Gear 64 is fixed to tube 66 of wrap-spring clutch 68.

Wrap-spring clutch 68 is a well known, conventional mechanism which engages tube 66 to inner shaft 70 when tube 66 is free to rotate, and disengages tube 66 from inner shaft 70 if tube 66 is prevented from rotating.

Inner shaft 70 drives gear 74 which drives gear 76, which in turn drives shaft 78 (shown partly broken away) and pulleys 80. Belts 26 are mounted around pulleys 80 and rear pulley assembly 82 so that as inner shaft 70 rotates pusher 22 advances the stack towards feeder mechanism 36, as described above.

A ratchet 86 is fixed to the outer circumference of tube 66 to engage a pawl 88 which is fixed to housing 40.

In operation, a stack of print media, which in the embodiment of FIG. 1 are envelopes, is loaded into tray 23. Assuming that initially the stack of envelopes is not advanced far enough to engage feeder mechanism 36, spring 54 will advance feeder mechanism 36 to a first position where pawl 88 does not engage ratchet 86; allowing tube 66 to rotate freely and engage inner shaft 70; in turn driving belts 26 and advancing pusher 22 to advance the stack towards feeder mechanism 36. As the stack advances feeder mechanism 36 will rotate around shaft 32 back to a second position where pawl 88 engages ratchet 86 stopping tube 66 and disengaging inner shaft 70, in turn stopping pusher 22. During this time belts 50 will sequentially feed the front envelope from stack S upwards, away from deck 12, for further processing, which does not form a part of the subject invention. As successive sheets are fed from the stack spring 54 will urge feeder mechanism 36 back towards the first position until pawl 88 gain releases ratchet 86 and the cycle repeats. Because feeder mechanism 36 moves a relatively small distance, in a preferred embodiment approximately 0.120 inches, between the first and second positions, spring 54 may be easily designed to maintain a constant normal force and the design of feeder mechanism 36 is greatly simplified. Other feeders have attempted to rely upon the stack advance mechanism both to advance the stack as items are fed and to maintain a constant normal force between the stack and the feeder mechanism. The present invention eliminates this difficulty. Thus sheet feeder 10 is effectively a demand feeder advancing the stack only as needed and maintaining a constant normal force at feeder mechanism 36 without need for sophisticated sensors motors or controls.

In a preferred embodiment motor 30 rotates shaft 32 at a rate selected to provide a belt speed of approximately 3.3 inches per second and the various gear ratios and pulley sizes selected to drive belts 26 are chosen to advance pusher 22 at a desired rate, which in a preferred embodiment is approximately 0.44 inches per second, while coupling sufficient torque through gear 60 to allow pusher 22 to overcome the resistance of spring 54. Details of such design are a matter of routine to those skilled in the mechanical arts and need not be discussed further here for an understanding of the subject invention.

The above detailed description has been provided by way of illustration only and numerous other embodiments of the subject invention will be apparent to those skilled in the art from consideration of the above description and the attached drawings. For example the movement of the feeder mechanism may be translational rather than rotational and mechanisms for activating the pusher may be used, for example a separate motor controlled by a switch responsive to the position of the feeder mechanism. Accordingly limitations on the subject invention are to be found only in the claims set forth below.

What is claimed is:

1. An apparatus for feeding items from a stack of print media, comprising:

a) feeder means for feeding items from said stack, said feeder memos moving cyclically between a first position and a second position;

b) stack advance means for moving said stack towards said feed means when said stack advance means is activated;

c) activating means for activating said stack advance means when said feeder means feeds successive ones of said items from said stack and advances to said first position, and for deactivating said stack advance means when said stack advance means moves said stack against said feeder means and returns said feeder means to said second position, wherein said activating means comprises: a wrap-spring clutch for coupling a motive force to said stack advance means; a ratchet fixed to said clutch; and a pawl fixed to said feeder means; wherein said pawl is disengaged from said ratchet when said feeder means is in said first position whereby said clutch is engaged and said stack advance means is activated, and said pawl is engaged with said ratchet and said clutch is disengaged and said stack advance means is deactivated when said feeder means is in said second position.

2. An apparatus as described in claim 1, wherein said stack advance means comprises a pusher element bearing upon a last item in said stack, said pusher element driving said stack towards said feeder means when said stack advance means is activated.

3. An apparatus as described in claim 1, further comprising: a mechanism for providing a normal force between said feeder means and said stack, said normal force being substantially constant over a range of movement of said feeder means, and said first and second positions are within said range.

4. An apparatus as described in claim 3, wherein the length of said range is approximately 0.120 inches.

5. An apparatus for feeding items from a stack of print media, comprising:

a) a friction drive mechanism bearing upon and feeding successive first items in said stack, said friction drive mechanism advancing to a first position as said successive first items are fed from said stack, said friction drive mechanism is driven by one or more gears wherein said friction drive mechanism comprises: a belt mechanism including a first drive pulley fixed to a first shaft, a first idler pulley spaced from said first drive pulley, and an endless friction belt driven by said first drive pulley around said first idler pulley, said belt mechanism pivoting around said first shaft between said first position and a second position; and a resilient mechanism for urging said belt mechanism against said stack, where the force of said resilient mechanism is substantially constant as said belt mechanism pivots between said first and second positions;

b) a stack advance mechanism bearing upon a last item in said stack, said stack advance mechanism moving towards said friction drive mechanism when said stack advance mechanism is activated, said stack advance mechanism advancing said stack and returning said friction drive mechanism to said second position, wherein said stack advance mechanism comprises: a second drive pulley coupled to an output of a clutch; a second idler pulley spaced from said second drive pulley; a drive belt driven by said second drive pulley around said second idler pulley; and a pusher element bearing on said last item in said stack for driving said stack towards said friction drive mechanism when said clutch is engaged; and wherein said clutch has an input coupled to said gears and said clutch output couples motive power to said stack advance mechanism, said clutch responding to said friction drive mechanism to couple said motive power to and activate said stack advance mechanism when said friction drive mechanism is in said first position and to decouple said motive power when said friction drive mechanism is in said second position.

* * * * *

UNITED STATES PATENT AND TRADEMARK OFFICE
CERTIFICATE OF CORRECTION

PATENT NO : 5,584,476
DATED : December 17, 1996
INVENTOR(S) : Joseph H. Marzullo, et al.

It is certified that error appears in the above-identified patent and that said Letters Patent is hereby corrected as shown below:

On title page, insert --[73] Assignee: Pitney Bowes Inc., Stamford, Conn.--

Signed and Sealed this

Fourth Day of November, 1997

Bruce Lehman

*Attest:*

BRUCE LEHMAN

*Attesting Officer*

*Commissioner of Patents and Trademarks*